US006818368B2

(12) United States Patent
Tanaka et al.

(10) Patent No.: US 6,818,368 B2
(45) Date of Patent: Nov. 16, 2004

(54) ELECTROPHOTOGRAPHIC PHOTOSENSITIVE MEMBER, PROCESS CARTRIDGE, AND ELECTROPHOTOGRAPHIC APPARATUS

(75) Inventors: Takakazu Tanaka, Shizuoka (JP); Mitsuhiro Kunieda, Shizuoka (JP); Yuka Nakajima, Shizuoka (JP); Harunobu Ohgaki, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/832,920

(22) Filed: Apr. 12, 2001

(65) Prior Publication Data

US 2002/0048710 A1 Apr. 25, 2002

(30) Foreign Application Priority Data

Apr. 14, 2000 (JP) ..... 2000-113811

(51) Int. Cl.[7] ..... G03G 5/04; G03G 15/00

(52) U.S. Cl. ..... 430/73; 430/58.65; 430/135; 399/115; 399/116; 399/159; 399/176

(58) Field of Search ..... 430/56, 58.65, 430/58.75, 58.8, 72, 73, 135; 399/115, 116, 159, 176; 564/307, 308, 309

(56) References Cited

U.S. PATENT DOCUMENTS

| | | | | |
|---|---|---|---|---|
| 4,030,923 | A | | 6/1977 | Krause et al. |
| 4,123,269 | A | | 10/1978 | Von Hoene et al. |
| 4,338,388 | A | | 7/1982 | Sakai et al. ..... 430/79 |
| 4,859,556 | A | | 8/1989 | Sasaki ..... 430/73 |
| 4,920,022 | A | * | 4/1990 | Sakakibara et al. ..... 430/58.8 |
| 5,098,809 | A | * | 3/1992 | Kikuchi et al. ..... 430/73 |
| 5,430,526 | A | * | 7/1995 | Ohkubo et al. |
| 5,495,049 | A | * | 2/1996 | Nukada et al. ..... 564/433 |
| 5,723,671 | A | * | 3/1998 | Goodbrand et al. ..... 564/405 |
| 5,929,281 | A | | 7/1999 | Nishiyama et al. ..... 564/386 |
| 6,228,547 | B1 | * | 5/2001 | Kobayashi et al. ..... 430/58.75 |
| 6,242,648 | B1 | * | 6/2001 | Yamasaki et al. ..... 564/405 |

FOREIGN PATENT DOCUMENTS

| | | | |
|---|---|---|---|
| JP | 72231 | | 6/1977 |
| JP | 58445 | | 5/1979 |
| JP | 151955 | | 11/1979 |
| JP | 52063 | | 4/1980 |
| JP | 195254 | | 11/1982 |
| JP | 198043 | | 11/1983 |
| JP | 5-78261 | * | 3/1993 |
| JP | 139742 | | 5/1998 |
| JP | 310561 | | 11/1998 |
| JP | 11-282180 | * | 10/1999 |

OTHER PUBLICATIONS

Japanese Patent Office Machine–Assisted Translation of JP 11–282180 (Pub Oct. 1999).*

Grant, R. et al., Ed. *Grant & Hackh's Chemical Dictionary*, 5th Edition, McGraw–Hill Book Co, NY (1987), p. 4, 1987.*

Grant, R. et al, Eds. *Grant & Hackh's Chemical Dictionary*, Fifth Edition, McGraw–Hill Book Company, NY(1987), p. 240, 1987.*

Diamond, A.S. Ed, *Handbook of Imaging Materials*, Marcel Dekker, Inc., NY (1991), p. 395, 1991.*

Japanese Patent Office Machine–Assisted Translation of JP 5–078261 (Pub Mar. 30, 1993).*

Derwent Abstract Acc. No. 1993–140306 Describing JP 5–78261, Mar. 1993.*

Caplus Abstract AN 1993: 603127 Describing JP 5–78261, 1993.*

U.S. patent application Ser. No. 09/361,803, Kunieda et al., filed Jul. 1999.

Wolfe, et al.; "Palladium–Catalyzed Animation of Aryl Iodides", J. Org. Chem (1996) 61, 1133–1135.

Old, et al.; "A Highly Active Catalyst for Palladium–Catalyzed Cross–Coupling Reactions: Room–Temperatures Suzuki Couplings and Animation of Unactivated Aryl Chlorides", J. Am. Chem. Soc. (1988) 120, 9722–9723.

* cited by examiner

*Primary Examiner*—Janis L. Dote
(74) *Attorney, Agent, or Firm*—Fitzpatrick, Cella, Harper & Scinto

(57) ABSTRACT

An electrophotographic photosensitive member includes a charge generating material and a charge transfer material. The charge transfer material contains a triarylamine compound synthesized from an amine compound and an aryl halide in the presence of a catalyst comprising a phosphine compound represented by formula (1) and a palladium compound:

(1)

wherein $Ar^1$ to $Ar^3$ are each independently an alkyl or aryl group which may have a substituent group, and at least one of $Ar^1$ to $Ar^3$ is an aryl group. A process cartridge includes the electrophotographic photosensitive member.

14 Claims, 1 Drawing Sheet

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the Invention

The present invention relates to electrophotographic photosensitive members, process cartridges, and electrophotographic apparatuses. In particular, the present invention relates to an electrophotographic photosensitive member using a charge transfer material synthesized by a specific method, a process cartridge and an electrophotographic apparatus which include the electrophotographic photosensitive member, and a process for producing the electrophotographic photosensitive member.

2. Description of the Related Art

In recent years, laminate-type electrophotographic photosensitive members, each having a photosensitive layer including a charge generating layer and a charge transfer layer, have been proposed. The electrophotographic photosensitive members having the laminate structure have improved in sensitivity to visible light, charge retention, and surface strength. Many organic compounds have been proposed as charge transfer materials. For example, Japanese Unexamined Patent Application Publication No. 52-72231 discloses pyrazoline compounds, Japanese Unexamined Patent Application Publication No. 55-52063 discloses hydrazone compounds, Japanese Unexamined Patent Application Publication Nos. 54-58445 and 57-195254 disclose triphenylamine compounds, and Japanese Unexamined Patent Application Publication Nos. 54-151955 and 58-198043 disclose stilbene compounds. Since triarylamine compounds having a triphenylamine structure have superior electrophotographic characteristics, such as easy molecular design and high hole mobility, many novel proposals have been disclosed.

However, electrophotographic photosensitive members using these triarylamine compounds as charge transfer materials do not always have adequate sensitivity and still require improvements in potential variation when being repeatedly used and image defects at low humidity and high humidity.

The characteristics of the electrophotographic photosensitive member are affected by not only the structure of the charge transfer material but also the purity thereof. In particular, it is known that the variation of the rest potential is greatly affected by the impurities in the charge transfer material. Thus, it is preferable that the purity of the charge transfer material used in the electrophotographic photosensitive member be higher and the impurity content be lower. It is considered that the impurities trap holes, which are carriers in the charge transfer layer, and inhibits carrier transfer and that the accumulated holes form space charge, which is a factor of variations of the resist potential. Thus, it is preferable that the impurity content be lower.

In conventional production processes of charge transfer materials, the final stages of the processes include purification treatments, such as recrystallization and column chromatography. However, recrystallization does not sufficiently remove impurities and results in a low yield of the final product. Column chromatography uses expensive chromatograph-grade silica gel or alumina and large amounts of hazardous flammable organic solvents, having cost and safety problems.

An arylamine compound used in the charge transfer material is synthesized by the condensation reaction of the corresponding aryl halide with an amine compound. For example, synthesis from the corresponding iodbbenzene and an amine compound in the presence of a copper catalyst (Ullmann reaction) is known (refer to "Daiyuukikagaku", vol. 16, p. 52 (1959), Asakura Shoten; and "Yuukikagaku Koza", vol. 3, p. 66 (1983), Maruzen). This reaction, however, requires a large amount of copper catalyst, a high reaction temperature, and a prolonged reaction time. Thus, this reaction results in a low arylamine yield and forms byproducts, such as colored impurities and decomposition products, which adversely affect electrophotographic characteristics, and thus requires much purification cost.

Stephan L. Buchwald et al. discloses synthesis of arylamines from aryl halides and amines in the presence of a catalyst including a phosphine and a palladium compound (Tetrahedron Letters, Vol. 36, No. 21, 3609 (1955); and J. Am. Chem. Soc., Vol. 120, 9722 (1988)). Since this reaction proceeds under a relatively mild condition, the impurity yield is significantly low compared to the Ullmann reaction. John F. Hartwig et al. also discloses a similar reaction (J. Org. Chem., 61, 1133 (1996))

Moreover, as synthesis of triarylamines by applying these methods, Japanese Unexamined Patent Application Publication Nos. 10-139742 and 10-310561 disclose synthesis using a catalyst including a trialkylphosphine and a palladium compound. Although these methods have advantages, such as a relatively low reaction temperature and a shortened reaction time, use of expensive trialkylphosphines causes increased production cost. Moreover, these methods causes new problems, for example, insufficient stability of the preserved catalyst and possibility of spontaneous combustion.

The present inventors have concentrically investigated means for solving the above problems and have found that compounds having a specific structure among phosphine compounds used for synthesizing triarylamines by the reaction proposed by Stephan L. Buchwald exhibit low cost, superior preservation stability, and high safety and that electrophotographic photosensitive members using these triarylamines exhibit stable potentials during endurance testing and environmental stability.

SUMMARY OF THE INVENTION

Accordingly, it is an object of the present invention to provide an electrophotographic photosensitive member which exhibits endurance stability and can be readily produced with relatively low cost, and a process cartridge and an electrophotographic apparatus having this electrophotographic photosensitive member.

According to a first aspect of the present invention, an electrophotographic photosensitive member comprises a charge generating material and a charge transfer material, wherein the charge transfer material comprises a triarylamine compound synthesized from an amine compound and an aryl halide in the presence of a catalyst comprising a phosphine compound represented by formula (1) and a palladium compound:

(1)

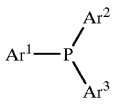

wherein $Ar^1$ to $Ar^3$ are each independently an alkyl or aryl group which may have a substituent group, and at least one of $Ar^1$ to $Ar^3$ is an aryl group which may have a substituent group.

Examples of the alkyl groups in the formula include a methyl group, an ethyl group, a propyl group, a n-butyl group, a tert-butyl group, and a cyclohexyl group, and examples of the aryl groups include fused-ring hydrocarbon groups, such as a phenyl group, a biphenyl group, a terphenyl group, a naphthyl group, an anthryl group, a phenanthryl group, and a pyrenyl group.

Examples of substituent groups in the alkyl or aryl group include alkyl groups, e.g., a methyl group, an ethyl group, a propyl group, and a butyl group; alkoxy groups, e.g., a methoxy group and an ethoxy group; and alkyl-substituted amino groups, e.g., a dimethylamino group and a diethylamino group.

The present invention is also directed to a process cartridge and an electrophotographic apparatus having the above electrophotographic photosensitive member.

The present invention is also directed to a process for producing the electrophotographic photosensitive member.

Further objects, features and advantages of the present invention will become apparent from the following description of the preferred embodiments with reference to the attached drawings.

DESCRIPTION OF THE PREFERRED EMBODIMENTS

Figure 1:
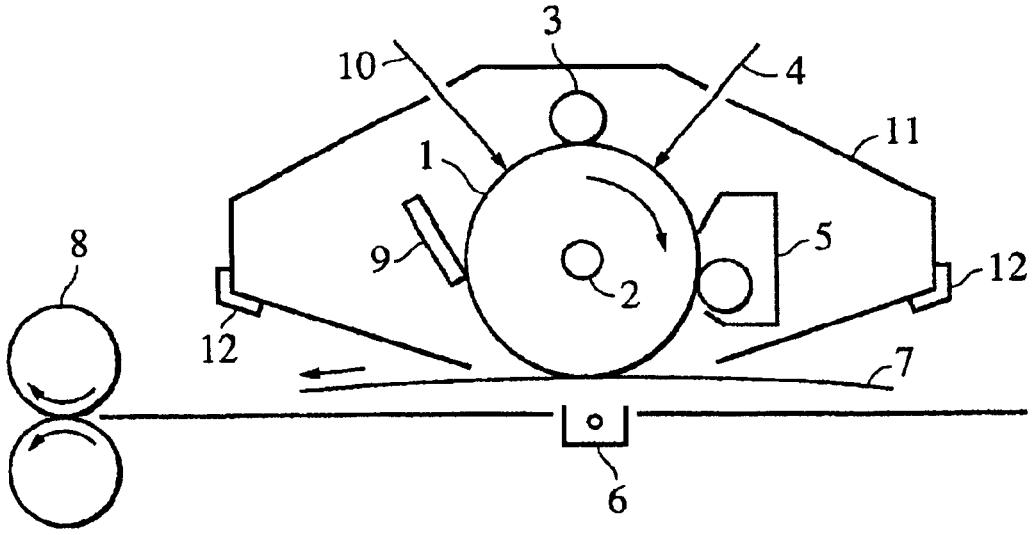
FIG. 1 is an outline view illustrating a configuration of an electrophotographic apparatus including a process cartridge having an electrophotographic photosensitive member of the present invention.

The charge transfer material used in the present invention is a triarylamine compound which is synthesized from an amine compound and an aryl halide in the presence of a catalyst including a phosphine compound represented by formula (1) and a palladium compound:

(1)

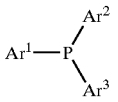

wherein $Ar^1$ to $Ar^3$ are each independently an alkyl or aryl group which may have a substituent group, and at least one of $Ar^1$ to $Ar^3$ is an aryl group which may have a substituent group.

The catalytic mechanism in the present invention in the present invention is presumed that the palladium atom coordinated with the phosphine compound as a ligand works, although its detail mechanism is not clear. That is, the palladium compound coordinated with the phosphine compound forms an oxidative adduct with the aryl halide. Then, the halogen is eliminated and the palladium atom is simultaneously coordinated with the aryl amine. Finally, the palladium catalyst is reductively eliminated from the amine to form the triarylamine. It is considered that the base promotes the elimination of halogen.

Preferably, the triphenylamine compound is represented by formula (2), (3) or (4):

(2)

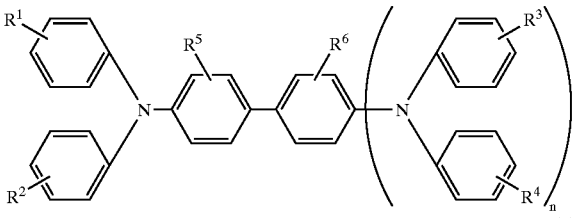

(3)

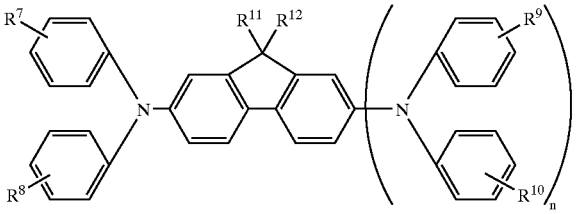

(4)

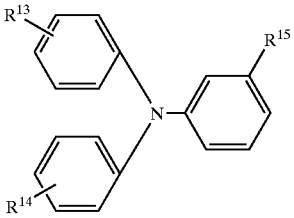

wherein $R^1$ to $R^{15}$ are each independently a hydrogen atom or an alkyl or alkoxy group which may have a substituent group, or a halogen atom, and n is an integer of 0 or 1.

The alkyl groups represented by $R^1$ to $R^{15}$ in formulae (2), (3), and (4) include a methyl group, an ethyl group, a propyl group, a n-butyl group, and a tert-butyl group. The alkoxy groups represented by $R^1$ to $R^{12}$ include a methoxy group and an ethoxy group. The halogen atoms represented by $R^1$ to $R^{15}$ are a fluorine atom, a chlorine atom, and a bromine atom.

Examples of substituent groups in the alkyl or alkoxy group include alkyl groups, e.g., a methyl group, an ethyl group, a propyl group, and a butyl group.

Since the phosphine compound represented by formula (1) has at least one aryl group, this compound exhibits significantly improved preservation stability compared to trialkylamines. For example, tri-tert-butylphosphine must be preserved in a sealed container containing inert gas, whereas di-tert-butylphenylphosphine can be preserved in atmospheric air.

In the present invention, the phosphine compound represented by formula (1) has an alkyl group which may have a substituent group or substituent groups, and it is preferable that at least one alkyl group be a tert-butyl group.

In the present invention, the phosphine compound represented by formula (1) has an aryl group which may have a substituent group or substituent groups, and it is preferable that at least one aryl group be a biphenyl group.

Nonlimiting examples of the phosphine compounds used in the present invention will be described below.

(P-1)
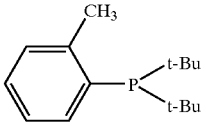
(P-2)
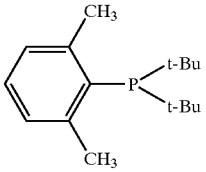
(P-3)
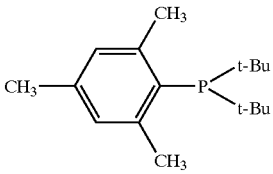
(P-4)
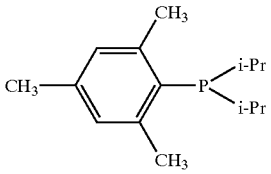
(P-5)
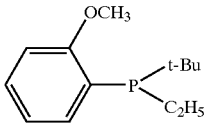
(P-6)
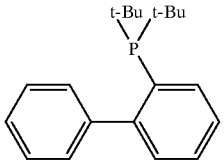
(P-7)
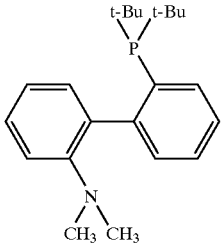
(P-8)
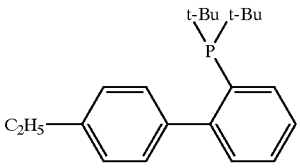
-continued
(P-9)
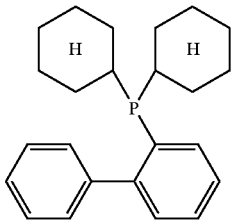
(P-10)
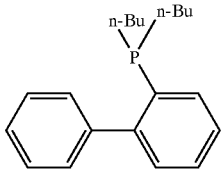
(P-11)
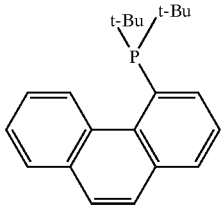
(P-12)
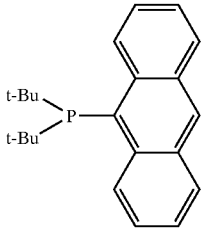
(P-13)
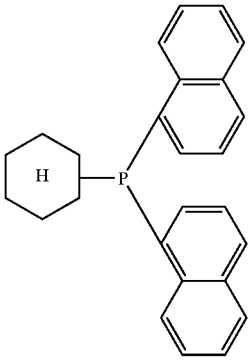
(P-14)
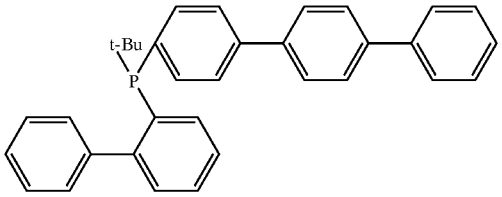

-continued (P-15)

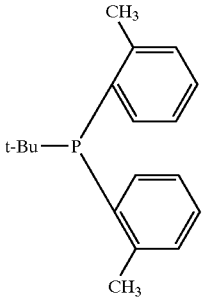

(P-16)

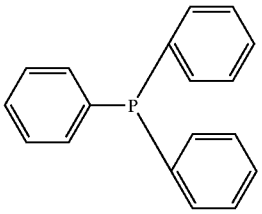

Among these, compounds (P-6), (P-7), and (P-10) are preferable, and compound (P-6), that is, di-tert-butylbiphenylphosphine is more preferable.

Nonlimiting examples of palladium compounds used in the present invention include tetravalent palladium compounds, e.g., sodium hexachloropalladium(IV) tetrahydrate and potassium hexachloropalladium(IV) tetrahydrate; divalent palladium compounds, e.g., palladium(II) chloride, palladium(II) bromide, palladium(II) acetate, palladium(II) acetylacetonate, dichlorobis(benzonitrile)palladium(II), dichlorobis(triphenylphosphine)palladium(II), dichlorotetramine palladium(II), and dichloro(cycloocta-1,5-diene) palladium(II); and other palladium compounds, e.g., tris (dibenzylideneacetone)dipalladium(0), tris (dibenzylideneacetone)dipalladium(0) chloroform complex, and tetrakis(triphenylphosphine)palladium(0).

Preferably, the charge transfer material of the present invention is synthesized in the presence of a base. The base may be selected from inorganic and/or organic base without limitation. Examples of preferable bases include alkali metal alkoxides, e.g., sodium methoxide, sodium ethoxide, potassium methoxide, potassium ethoxide, lithium tert-butoxide, sodium tert-butoxide, and potassium tert-butoxide. Among these alkali metal alkoxides, sodium tert-butoxide is more preferable. Inorganic bases, such as tripotassium phosphate and cesium fluoride, are also useful.

In the present invention, any inert organic solvent other than halogenated solvents may be used without limitation. Aromatic solvents, e.g., toluene and xylene, and ether solvents, e.g., monoglyme (ethylene glycol dimethyl ether), are more preferable, since these solvents exhibit high solubility to raw materials.

Nonlimiting examples of the charge transfer materials used in the present invention are as follows.

(CT-1)

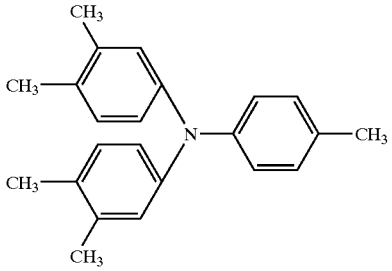

(CT-2)

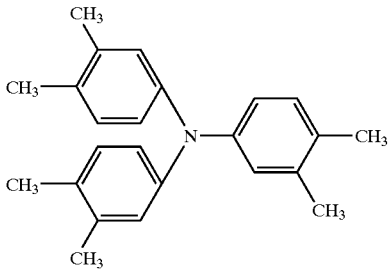

(CT-3)

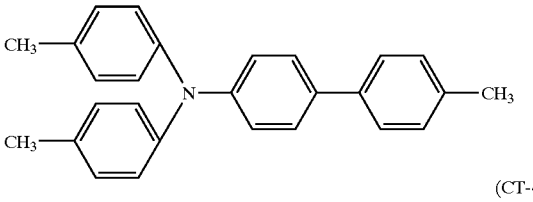

(CT-4)

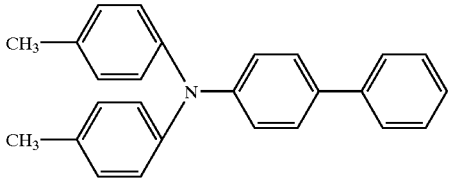

(CT-5)

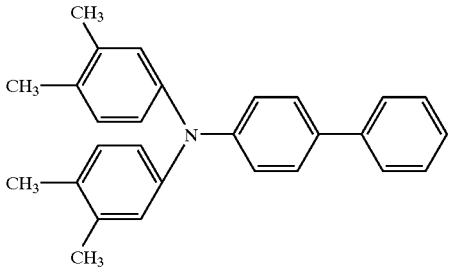

(CT-6)

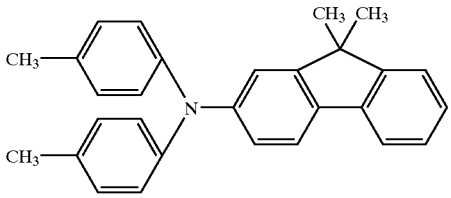

(CT-7)

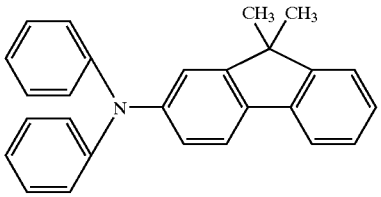

-continued (CT-8)

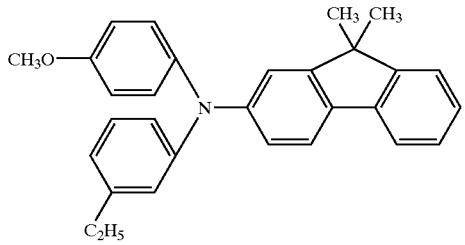

(CT-9)

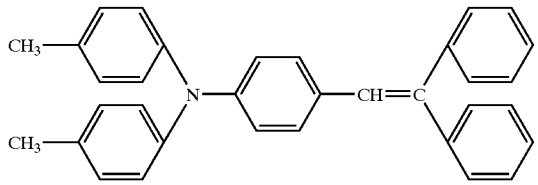

(CT-10)

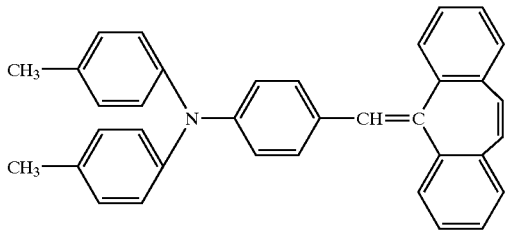

(CT-11)

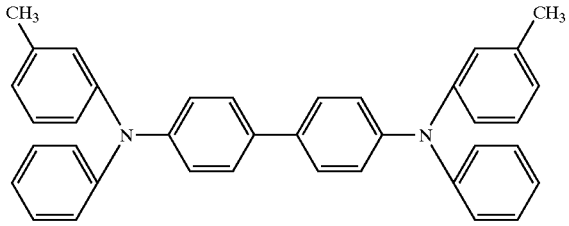

(CT-12)

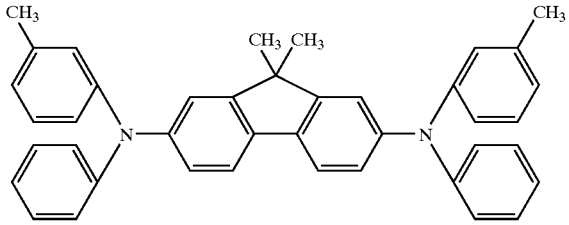

Among these, compounds (CT-5), (CT-6), (CT-7), (CT-10), (CT-11), and (CT-12) are preferable. Compounds (CT-5), (CT-6), and (CT-11) are more preferable, and compound (CT-6)is most preferable.

Examples of aryl halides used in the present invention include aryl chlorides, aryl bromides, and aryl iodides.

Any combination of the aryl halides and the amine compounds may be employed in the present invention, according to the structure of a desired charge transfer material. A combination of an aryl monohalide and a monoarylamine or of an aryl dihalide and a diarylamine is preferable for synthesis of a low molecular weight charge transfer material, whereas a combination of an aryl dihalide or aryl trihalide with a diarylamine is preferable for synthesis of a high molecular weight charge transfer material.

A configuration of the electrophotographic photosensitive member used in the present invention will now be described.

The electrophotographic photosensitive member of the present invention may be of a single-layer type having a single photosensitive layer containing both the charge transfer material and the charge generating material or of a laminate type having a charge transfer layer and a charge generating layer. The laminate-type electrophotographic photosensitive member is preferable in view of electrophotographic characteristics.

A support used in the present invention may be any conductive material. Examples of such supports include metals, e.g., aluminum and stainless steel, and metals, paper and plastics having conductive layers. The support may have any shape, for example, may be a sheet or a cylinder.

When a laser beam is used as exposure light in laser beam printers and the like, a conductive layer may be provided to prevent the generation of interference fringes and flaws on the support. The conductive layer may be formed by dispersing conductive powder such as carbon black or metal particles into a binding resin. The thickness of the conductive layer is in the range of preferably 5 to 40 $\mu$m and more preferably 10 to 30 $\mu$m.

An interlayer having an adhesive function is provided thereon. Examples of materials for the interlayer include polyamides, polyvinyl alcohol, polyethylene oxide, ethyl cellulose, case in, polyurethanes, and polyether polyurethanes. These materials are dissolved into an appropriate solvent before coating. The thickness of the interlayer is in the range of preferably 0.05 to 5 $\mu$m and more preferably 0.3 to 1 $\mu$m.

The charge generating layer is formed on the interlayer. Examples of charge generating materials used in the present invention include dyes, such as selenium-tellurium dyes, pyrylium dyes, and thiapyrylium dyes; and pigments, such as phthalocyanine pigments, anthanthrone pigments, dibenzopyrenequinone pigments, trisazo pigments, cyanine pigments, bisazo pigments, monoazo pigments, indigo pigments, quinacridone pigments, and asymmetric quinocyanine pigments.

In the laminate-type (independent functional type) electrophotographic photosensitive member, the charge generating layer is formed as follows, for example. One of the above charge generating material, 0.3 to 4 times of a binding resin, and a solvent are thoroughly dispersed using a homogenizer, an ultrasonic agitator, a ball mill, a vibrating ball mill, a sand mill, an attritor, a roll mill, or a liquid-collision-type high-rate dispersion machine. The dispersion is coated onto a support and dried. The thickness of the charge generating layer is preferably 5 $\mu$m or less and more preferably in the range of 0.1 to 2 $\mu$m.

The charge transfer layer is formed by applying a coating solution containing a charge transfer material of the present invention and a binding resin and then by drying the coated layer. Examples of binding resins used in the present invention include polycarbonates, polyarylates, polyesters, polystyrene, styrene-acrylonitrile copolymers, polysulfones, polymethacrylate esters, and styrene-methacrylate copolymers.

A charge transfer material and 0.5 to 2 times of a binder resin are used in combination, and the mixture is applied and then dried to form a charge transfer layer. The thickness of the charge transfer layer is in the range of preferably 5 to 40 $\mu$m and more preferably 15 to 30 $\mu$m.

FIG. 1 shows an outline configuration of an electrophotographic apparatus including a process cartridge having the electrophotographic photosensitive member of the present invention.

The drum electrophotographic photosensitive member 1 of the present invention rotates around a shaft 2 along the arrow at a predetermined peripheral velocity. The electrophotographic photosensitive member 1 is uniformly charged to a predetermined negative or positive potential by a primary charge means 3, and is exposed by exposure light 4 which is output from an exposure means (not shown in the drawing), such as slit exposure means or laser beam scanning exposure means, and is enhanced and modulated in response to time-series digital image signals based on image information. An electrostatic latent image in response to the image information is gradually formed on the electrophotographic photosensitive member 1.

The electrostatic latent image is developed with a toner by a develop means 5, and the toner image held on the electrophotographic photosensitive member 1 is gradually transferred onto a transfer material 7 which is fed between the electrophotographic photosensitive member 1 and a transfer means 6 from a feeding section (not shown in the drawing) in synchronization with the rotation of the electrophotographic photosensitive member 1. The transfer material 7 is detached from the electrophotographic photosensitive member 1, is introduced into an image fixing means 8 to fix the image, and is expelled from the apparatus as a printed copy.

The residual toner on the surface of the electrophotographic photosensitive member 1 after the image transfer is removed by a cleaning means 9 and the surface is deelectrified by preexposure light 10 from a preexposure means (not shown in the drawing) to be reused for forming the next image. When the primary charge means 3 is a contact charge means using a charge roller, preexposure is not always necessary.

In the present invention, plural components among the electrophotographic photosensitive member 1, primary charge means 3, the develop means 5, and the cleaning means 9 may be integrally loaded into a container 11 as a process cartridge, which can be attachable to and detachable from an electrophotographic apparatus body, such as a copying machine or a laser beam printer. For example, at least one component of the primary charge means 3, the develop means 5, and the cleaning means 9 is integrated with the electrophotographic photosensitive member 1 in a cartridge. This process cartridge can be attachable to and detachable from the apparatus body by a guide means 12 such as rails.

In the electrophotographic apparatus, such as a copying machine or a printer, the exposure light 4 is reflected or transmitted light from a document, or light emitted by laser beam scanning or by LED array drive or liquid shutter array drive based on signals from a sensor which reads the document.

The electrophotographic photosensitive member of the present invention is applicable to not only electrophotographic copying machines, but also various electrophotographic machines, such as laser beam printers, CRT printers, LED printers, facsimiles, liquid crystal printers, and laser plate making.

The present invention will now be described in more detail with reference to the following EXAMPLES. In those EXAMPLES, "pbw" refers to parts by weight.

SYNTHETIC EXAMPLE 1

Into a 100 ml eggplant type flask with a cooling tube was placed 4.36 g (20 mmol) of 4-iodotoluene, 4.96 g(22 mmol) of dixylylamine, and 20 ml of toluene, followed by stirring for 5 minutes at room temperature. After adding 2.69 g (28 mmol) of sodium tert-butoxide, 160 mg (0.7 mmol) of palladium acetate, and 640 mg (2.1 mmol) of di-tert-butylbiphenylphosphine (compound (P-6)), the mixture was refluxed for 20 minutes. After cooling, 80ml of toluene and 100 ml of water were added and the mixture was stirred for 10 minutes. The organic layer was collected, was dried with sodium sulfate, and toluene was evacuated.

The crude product was purified through a silica gel column, and S.67 g (yield: 90.0%) of compound (CT-1) with a purity of 99.9% was obtained. The purity was determined by the area ratio of a gas chromatogram.

SYNTHETIC EXAMPLES 2 TO 10

Various charge transfer compounds were synthesized using the aryl halides, amine compounds, phosphorus compounds, and palladium compounds shown in Table 1, as in Synthetic Example 1.

TABLE 1

| Synthetic | | Starting Material | | Catalyst | | Purity |
|---|---|---|---|---|---|---|
| | | | | Phosphorus | Palladium | of Final |
| Example | Compound | Aryl Halide | Amine Compound | Compound | Compound | Product (%) |
| 2 | CT-1 | 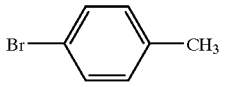 | 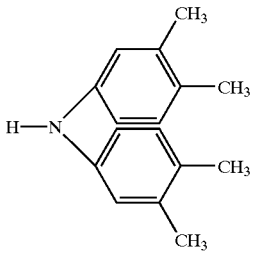 | P-1 | $Pd(OAc)_2$ | 99.8 |

TABLE 1-continued
| Synthetic Example | Compound | Starting Material: Aryl Halide | Starting Material: Amine Compound | Catalyst: Phosphorus Compound | Catalyst: Palladium Compound | Purity of Final Product (%) |
|---|---|---|---|---|---|---|
| 3 | CT-3 | 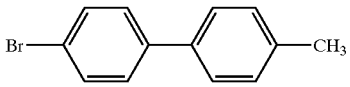 | 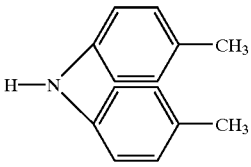 | P-6 | $Pd(OAc)_2$ | 99.9 |
| 4 | CT-3 | 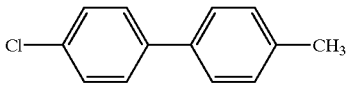 | 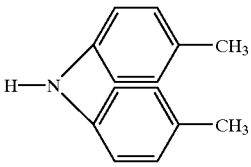 | P-6 | $Pd(OAc)_2$ | 99.8 |
| 5 | CT-5 | 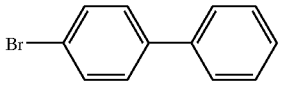 | 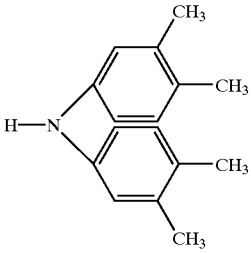 | P-7 | $Pd(OAc)_2$ | 99.9 |
| 6 | CT-6 | 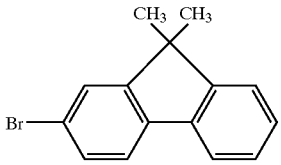 | 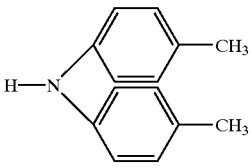 | P-8 | $PdCl_2$ | 99.9 |
| 7 | CT-8 | 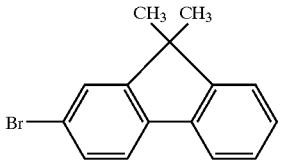 | 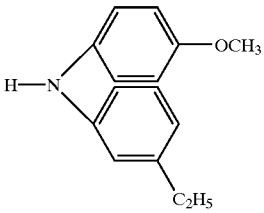 | P-10 | Tris(di-benzyliene-acetone)di-alladium (0) | 99.8 |
| 8 | CT-8 | 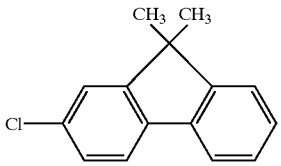 | 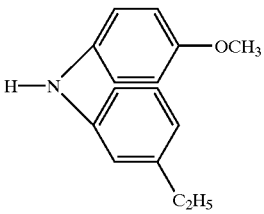 | P-11 | Tris(di-benzyliene-acetone)di-alladium (0) | 99.9 |
| 9 | CT-9 | 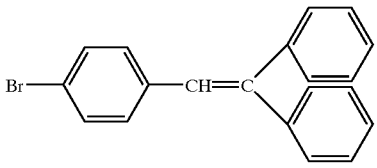 | 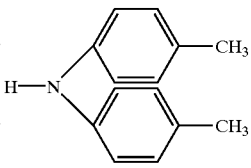 | P-15 | $PdCl_2$ | 99.9 |

TABLE 1-continued

| Synthetic Example | Compound | Starting Material: Aryl Halide | Starting Material: Amine Compound | Catalyst: Phosphorus Compound | Catalyst: Palladium Compound | Purity of Final Product (%) |
|---|---|---|---|---|---|---|
| 10 | CT-11 | 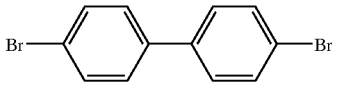 | 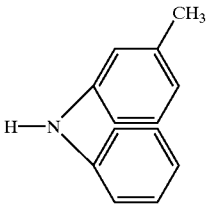 | P-16 | $Pd(OAc)_2$ | 99.9 |

COMPARATIVE SYNTHETIC EXAMPLE 1

Compound (CT-1) was synthesized from the aryl halide and the amine compound used in Synthetic Example 1 by the Ullmann reaction, which was known as a general method for synthesizing arylamine compounds.

Instead of sodium tert-butoxide, palladium acetate, and di-tert-butylbipnenylphosphine in Synthetic Example 1, 3.81 g (60 mmol) of copper powder and 5.53 g (40 mmol) of potassium carbonate were used. Moreover, o-dichlorobenzene was used instead of toluene in Synthetic Example 1, and the mixture was refluxed for 6 hours until 4-iodotoluene was completely consumed.

The crude product was purified as in Synthetic Example 1, and 4.10 g (yield: 65.0%, purity: 99.5%) of compound (CT-1) was obtained. The purity was determined by the area ratio of a gas chromatogram.

COMPARATIVE SYNTHETIC EXAMPLES 2 TO 10

Various charge transfer compounds were synthesized and purified as in Synthetic Examples 2 to 10 except that the synthetic conditions, that is, the catalyst, solvent, and the reaction time were based on Comparative Synthetic Example 1. The purity of each compound is shown in Table 2.

TABLE 2

| Comparative Synthetic Example | Charge Transfer Compound | Purity of Final Product (%) |
|---|---|---|
| 1 | CT-1 | 99.5 |
| 2 | CT-1 | 99.5 |
| 3 | CT-3 | 99.6 |
| 4 | CT-3 | 99.5 |
| 5 | CT-5 | 99.6 |
| 6 | CT-6 | 99.6 |
| 7 | CT-8 | 99.3 |
| 8 | CT-8 | 99.2 |
| 9 | CT-9 | 99.5 |
| 10 | CT-11 | 99.5 |

COMPARATIVE SYNTHETIC EXAMPLES 11 TO 20

Various charge transfer compounds were synthesized and purified as in Synthetic Examples 1 to 10 except that 425 mg (2.1 mmol) of tri-tert-butylphosphine was used instead of the phosphorus compounds. The purity and the yield (the amount and the rate) of each compound are shown in Table 3. The purity was determined by the area ratio of a gas chromatogram.

TABLE 3

| Comparative Synthetic Example | Charge Transfer Compound | Purity of Final Product (%) | Yield (g) [%] |
|---|---|---|---|
| 11 | CT-1 | 99.9 | 5.62 (89) |
| 12 | CT-1 | 99.9 | 5.49 (87) |
| 13 | CT-3 | 99.8 | 6.24 (86) |
| 14 | CT-3 | 99.8 | 6.46 (89) |
| 15 | CT-5 | 99.9 | 6.63 (88) |
| 16 | CT-6 | 99.8 | 6.77 (87) |
| 17 | CT-8 | 99.8 | 7.54 (90) |
| 18 | CT-8 | 99.9 | 7.37 (88) |
| 19 | CT-9 | 99.9 | 8.01 (90) |
| 20 | CT-11 | 99.9 | 8.87 (87) |

EXAMPLE 1

A coating solution composed of the following materials was applied onto an aluminum cylindrical support having a diameter of 30 mm and a length of 357 mm by dipping and was thermally cured at 140° C for 30 minutes to form a conductive layer having a thickness of 15 Am.

Composition of Coating Solution

Conductive pigment: barium sulfate coated with SnO210 pbw

Resistance-controlling pigment: titanium oxide 2 pbw

Binding resin: phenol resin 6 pbw

Leveling material: silicone oil 0.001 pbw

Solvent: methanol/methoxypropanol (0.2/0.8) 20 pbw

Next, a solution of 3 pbw of N-methoxymethylated nylon and 3 pbw of copolymeric nylon in methanol(65 pbw)/butanol(30 pbw) was applied thereon by dipping to form an interlayer having a thickness of 0.7 $\mu$m.

Then, 4 pbw of oxytitanium phthalocyanine having strong peaks at Bragg angles (2θ±0.20) 9.0°, 14.2°, 23.9°, and 27.1° in CuKa characteristic X-ray diffractometry, 2 pbw of polyvinyl butyral resin (S-LEC BX-1 made by Sekisui Chemical Co., Ltd.), and 60 pbw of cyclohexanone were dispersed in a sand mill containing glass beads for 3 hours, and then 100 pbw of ethyl acetate was added thereto to prepare a dispersion for a charge generating layer. The dispersion was applied onto the interlayer by dipping to form a charge generating layer having a thickness of 0.2 $\mu$m.

Next, 8 pbw of compound (CT-1) synthesized by Synthetic Example 1 and 10 pbw of polycarbonate resin (IUPILON Z-200, made by Mitsubishi Engineering Plastic Corp.) were dissolved into a mixed solvent of 40 pbw of monochlorobenzene and 40 pbw of dichloromethane. The coating solution was applied onto the charge generating layer by dipping, was dried at 100° C. for 1 hour to form a charge transfer layer having a thickness of 26 μm.

The resulting electrophotographic photosensitive member was loaded into a laser beam printer LBP-950 made by Canon K. K., and the dark potential Vd, the light potential Vl, and the residual potential Vr thereof were measured at a high-temperature high-humid environment of 30° C. and 85% relative humidity. This laser beam printer has been modified for measuring electrophotographic characteristics of the electrophotographic photosensitive member.

Moreover, 30,000 copying operations were repeated in the high-temperature high-humid environment to measure the dark potential Vd, the light potential Vl, and the residual potential Vr at the initial stage and at the 30,000th operation. The results are shown in Table 3.

EXAMPLES 2 TO 10

Electrophotographic photosensitive members were prepared and evaluated as in EXAMPLE 1 except that the charge transfer compounds synthesized in Synthetic Examples 2 to 10 were used instead of the charge transfer compound of EXAMPLE 1. The results are shown in Table 3.

COMPARATIVE EXAMPLES 1 TO 20

Electrophotographic photosensitive members were prepared and evaluated as in EXAMPLE 1 except that the charge transfer compounds synthesized in Comparative Synthetic Examples 1 to 20 were used instead of the charge transfer compound of EXAMPLE 1. The results are shown in Table 4.

TABLE 4

| Example No. | Charge Transfer Compound | Synthetic Example No. | Initial characteristics Vd (−V) | Vl (−V) | Vr (−V) | Change in Potential (30,000th - Initial) ΔVd (−V) | ΔVl (−V) | ΔVr (−V) | P Content* (ppm) |
|---|---|---|---|---|---|---|---|---|---|
| Example 1 | CT-1 | Synthetic Example 1 | 702 | 195 | 10 | 0 | 15 | 10 | 12 |
| Example 2 | CT-1 | Synthetic Example 2 | 700 | 200 | 15 | 0 | 15 | 10 | 15 |
| Example 3 | CT-3 | Synthetic Example 3 | 695 | 195 | 10 | 5 | 15 | 5 | 10 |
| Example 4 | CT-3 | Synthetic Example 4 | 700 | 198 | 5 | 5 | 15 | 5 | 18 |
| Example 5 | CT-5 | Synthetic Example 5 | 700 | 200 | 10 | 3 | 10 | 5 | 15 |
| Example 6 | CT-6 | Synthetic Example 6 | 698 | 200 | 10 | 3 | 5 | 0 | 8 |
| Example 7 | CT-8 | Synthetic Example 7 | 704 | 201 | 10 | 4 | 15 | 10 | 17 |
| Example 8 | CT-8 | Synthetic Example 8 | 710 | 200 | 10 | 0 | 14 | 10 | 15 |
| Example 9 | CT-9 | Synthetic Example 9 | 702 | 195 | 15 | 0 | 15 | 5 | 12 |
| Example 10 | CT-11 | Synthetic Example 10 | 700 | 198 | 10 | 0 | 10 | 5 | 10 |
| Comparative Example 1 | CT-1 | Comparative Synthetic Example 1 | 695 | 200 | 30 | 20 | 45 | 30 | — |
| Comparative Example 2 | CT-1 | Comparative Synthetic Example 2 | 690 | 200 | 35 | 20 | 50 | 25 | — |
| Comparative Example 3 | CT-3 | Comparative Synthetic Example 3 | 693 | 210 | 30 | 18 | 45 | 30 | — |
| Comparative Example 4 | CT-3 | Comparative Synthetic Example 4 | 695 | 206 | 30 | 25 | 48 | 30 | — |
| Comparative Example 5 | CT-5 | Comparative Synthetic Example 5 | 694 | 203 | 35 | 24 | 48 | 25 | — |
| Comparative Example 6 | CT-6 | Comparative Synthetic Example 6 | 687 | 200 | 30 | 17 | 40 | 30 | — |
| Comparative Example 7 | CT-8 | Comparative Synthetic Example 7 | 690 | 200 | 35 | 20 | 53 | 35 | — |
| Comparative Example 8 | CT-8 | Comparative Synthetic Example 8 | 692 | 198 | 40 | 22 | 55 | 40 | — |
| Comparative Example 9 | CT-9 | Comparative Synthetic Example 9 | 695 | 200 | 35 | 15 | 45 | 30 | — |
| Comparative Example 10 | CT-11 | Comparative Synthetic Example 10 | 685 | 205 | 30 | 20 | 45 | 25 | — |
| Comparative Example 11 | CT-1 | Comparative Synthetic Example 11 | 695 | 202 | 35 | 15 | 40 | 20 | 70 |
| Comparative Example 12 | CT-1 | Comparative Synthetic Example 12 | 700 | 200 | 30 | 10 | 35 | 30 | 65 |
| Comparative Example 13 | CT-3 | Comparative Synthetic Example 13 | 702 | 200 | 25 | 15 | 40 | 25 | 60 |
| Comparative Example 14 | CT-3 | Comparative Synthetic Example 14 | 705 | 200 | 20 | 20 | 35 | 30 | 72 |
| Comparative Example 15 | CT-5 | Comparative Synthetic Example 15 | 700 | 198 | 35 | 10 | 38 | 35 | 75 |
| Comparative Example 16 | CT-6 | Comparative Synthetic Example 16 | 698 | 195 | 30 | 14 | 42 | 32 | 70 |
| Comparative Example 17 | CT-8 | Comparative Synthetic Example 17 | 695 | 200 | 25 | 20 | 35 | 28 | 64 |
| Comparative Example 18 | CT-8 | Comparative Synthetic Example 18 | 700 | 203 | 30 | 15 | 35 | 25 | 55 |
| Comparative Example 19 | CT-9 | Comparative Synthetic Example 19 | 703 | 198 | 20 | 18 | 40 | 20 | 70 |
| Comparative Example 20 | CT-11 | Comparative Synthetic Example 20 | 698 | 200 | 25 | 15 | 36 | 25 | 68 |

*The Pd content was measured by fluorescent X-ray analysis.

The electrophotographic photosensitive members of EXAMPLES exhibit high durability compared with those of COMPARATIVE EXAMPLES. These results suggest that the synthesis of the charge transfer compounds using the phosphine compounds and the palladium compounds in accordance with the present invention can suppress the formation of impurities causing variations in potentials and yields high-purity products.

When the trialkylphosphines of COMPARATIVE EXAMPLES 11 to 20 are used, variations in potentials are noticeable regardless of high-purity products. It is considered that trace amounts of catalytic impurities remain in the charge transfer compounds and adversely affect the electrophotographic characteristics, although the reasons are not clear.

Accordingly, the electrophotographic photosensitive member of the present invention has high sensitivity, high durability, can be easily produced, and is relatively inexpensive. Moreover, a process cartridge and an electrophotographic apparatus including this electrophotographic photosensitive member can be provided.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A process cartridge comprising:

an electrophotographic photosensitive member and contact charging means for charging the electrophotographic photosensitive member, the electrophotographic photosensitive member and the contact charging means being integrated, and being attachable to and detachable from an electrophotographic apparatus body, the electrophotographic photosensitive member comprising a charge generating material and a charge transfer material, wherein the charge transfer material is a triphenylamine compound and is synthesized from an amine compound and an aryl halide in the presence of a catalyst comprising a phosphine compound represented by formula (1) and a palladium compound:

(1)

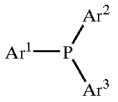

wherein $Ar^1$ to $Ar^3$ are each independently an alkyl or aryl group which may have a substituent group, and at least one of $Ar^1$ to $Ar^3$ is an aryl group which may have a substituent group, and at least one of $Ar^1$ to $Ar^3$ is a tert-butyl group, the triphenylamine compound is represented by formula (CT-8);

(CT-8)

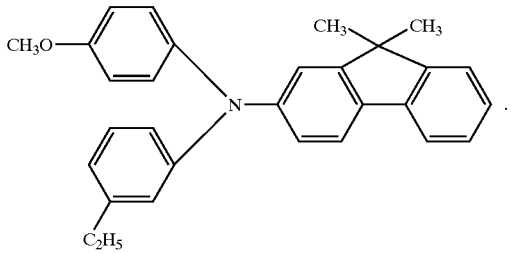

2. A process cartridge according to claim 1, wherein the triphenylamine compound is synthesized in the presence of a base.

3. A process cartridge according to claim 2, wherein the base is an alkali metal alkoxide.

4. A process cartridge according to claim 3, wherein the alkali metal alkoxide is a sodium tert-butoxide.

5. A process cartridge according to claim 1, wherein the phosphine compound has a biphenyl group which may have at least one substituent group.

6. A process cartridge according to claim 1, wherein the phosphine compound is di-tert-butylbiphenylphosphine.

7. An electrophotographic apparatus comprising:

an electrophotographic photosensitive member, contact charging means for charging the electrophotographic photosensitive member, exposure means for exposing the charged electrophotographic photosensitive member for forming an electrostatic latent image, developing means for developing the electrostatic latent image formed on the electrophotographic photosensitive member with a toner, and transfer means for transferring the toner image formed on the electrophotographic photosensitive member onto a transfer member, the electrophotographic photosensitive member comprising a charge generating material and a charge transfer material, wherein the charge transfer material is a triphenylamine compound and is synthesized from an amine compound and an aryl halide in the presence of a catalyst comprising a phosphine compound represented by formula (1) and a palladium compound:

(1)

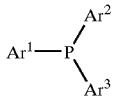

wherein $Ar^1$ to $Ar^3$ are each independently an alkyl or aryl group which may have a substituent group, and at least one of $Ar^1$ to $Ar^3$ is an aryl group which may have a substituent group, and at least one of $Ar^1$ to $Ar^3$ is a tert-butyl group, the triphenylamine compound is represented by formula (CT-8);

(CT-8)

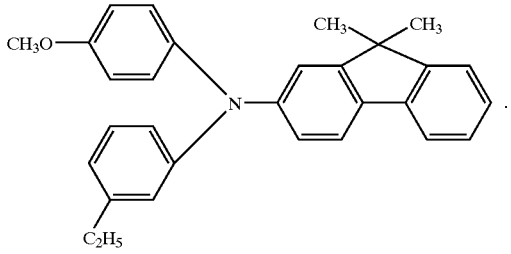

8. An electrophotographic apparatus according to claim 7, wherein the triphenylamine compound is synthesized in the presence of a base.

9. An electrophotographic apparatus according to claim 8, wherein the base is an alkali metal alkoxide.

10. An electrophotographic apparatus according to claim 9, wherein the alkali metal alkoxide is a sodium tert-butoxide.

11. An electrophotographic apparatus according to claim 7, wherein the phosphine compound has a biphenyl group which may have at least one substituent group.

12. An electrophotographic apparatus according to claim 7, wherein the phosphine compound is di-tert-butylphenylphosphine.

13. A process cartridge comprising:

an electrophotographic photosensitive member and contact charging means for charging the electrophotographic photosensitive member, the electrophotographic photosensitive member and the contact charging means being integrated, and being attachable to and detachable from an electrophotographic apparatus body, the electrophotographic photosensitive member comprising a charge generating material and a charge transfer material, wherein the charge transfer material is a triphenylamine compound and is synthesized from an amine compound and an aryl halide in the presence of a catalyst comprising a phosphine compound and a palladium compound, the triphenylamine compound is represented by formula (CT-8);

(CT-8)

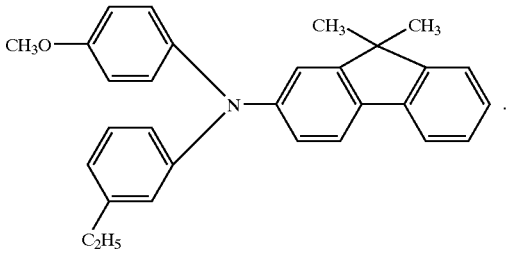

wherein the phosphine compound is (P-11)

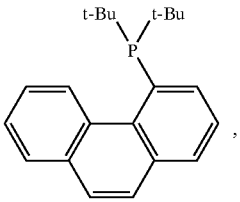

and the palladium compound is tris (dibenzylidenacetone) dipalladium(0).

14. An electrophotographic apparatus comprising:

an electrophotographic photosensitive member, contact charging means for charging the electrophotographic photosensitive member, exposure means for exposing the charged electrophotographic photosensitive member for forming an electrostatic latent image, developing means for developing the electrostatic latent image formed on the electrophotographic photosensitive member with a toner, and transfer means for transferring the toner image formed on the electrophotographic photosensitive member onto a transfer member, the electrophotographic photosensitive member comprising a charge generating material and a charge transfer material, wherein the charge transfer material is a triphenylamine compound and is synthesized from an amine compound and an aryl halide in the presence of a catalyst comprising a phosphine compound and a palladium compound, the triphenylamine compound is represented by formula (CT-8);

(CT-8)

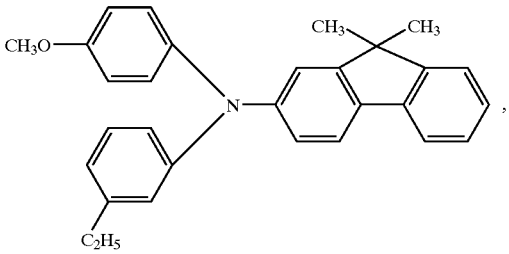

wherein the phosphine compound is (P-11)

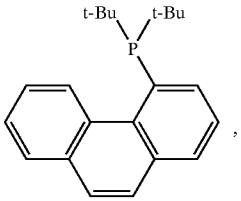

and the palladium compound is tris (dibenzylidenacetone) dipalladium(0).

* * * * *

UNITED STATES PATENT AND TRADEMARK OFFICE

CERTIFICATE OF CORRECTION

PATENT NO. : 6,818,368 B2
DATED : November 16, 2004
INVENTOR(S) : Takakazu Tanaka et al.

It is certified that error appears in the above-identified patent and that said Letters Patent is hereby corrected as shown below:

Column 2,
Line 2, “iodbbenzene” should read -- iodobenzene --;
Line 28, “causes” should read -- cause --; and
Line 31, “concentrically” should read -- concentratedly --.

Column 3,
Line 54, delete “in the present invention” first occurrence.

Column 9,
Line 59, “(CT-6)is” should read -- (CT-6) is --.

Column 10,
Line 30, “case in,” should read -- casein, --; and
Line 47, “material,” should read -- materials, --.

Column 12,
Line 36, “S. 67g” should read -- 5.67g --.

Column 13,
Synthetic Example 7, “alladium (D)” should read -- palladium (D) --; and
Synthetic Example 8, “alladium (D)” should read -- palladium (D) --.

Column 15,
Line 25, “di-tert-butylbipnenylphosphine” should read -- di-tert-butylbiphenylphosphine --.

Column 16,
Line 42, “15 Am.” should read -- 15$\mu$m. --;
Line 44, “SnO210” should read -- $SnO_2$ 10 pbw --;
Line 45, “pbw” should be deleted;
Line 55, “Bragg angles (2θ±0.20)” should read -- Bragg angles (2θ±0.2º) --; and
Line 56, “CuKa” should read -- CuKα --.

UNITED STATES PATENT AND TRADEMARK OFFICE

CERTIFICATE OF CORRECTION

PATENT NO. : 6,818,368 B2
DATED : November 16, 2004
INVENTOR(S) : Takakazu Tanaka et al.

It is certified that error appears in the above-identified patent and that said Letters Patent is hereby corrected as shown below:

Column 17,
Lines 9 and 14, “high-humid” should read -- high-humidity --.

Signed and Sealed this

Third Day of May, 2005

JON W. DUDAS
*Director of the United States Patent and Trademark Office*